US006517195B1

(12) United States Patent
Koeda

(10) Patent No.: US 6,517,195 B1
(45) **Date of Patent: *Feb. 11, 2003**

(54) INK JET HEAD WITH AN INTEGRATED CHARGING CONTROL CIRCUIT

(75) Inventor: Hiroshi Koeda, Fujimi-machi (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/202,488

(22) PCT Filed: Apr. 17, 1998

(86) PCT No.: PCT/JP98/01757

§ 371 (c)(1),
(2), (4) Date: Mar. 18, 1999

(87) PCT Pub. No.: WO98/47710

PCT Pub. Date: Oct. 29, 1998

(30) Foreign Application Priority Data

Apr. 18, 1997 (JP) ..... 9-102305

(51) Int. Cl.[7] ..... B41J 2/045
(52) U.S. Cl. ..... 347/68
(58) Field of Search ..... 347/54, 50, 9–11, 347/68, 69, 70, 71, 20, 59, 58, 57, 47, 40; 361/700; 399/261; 29/890.1

(56) References Cited

U.S. PATENT DOCUMENTS

| | | | | |
|---|---|---|---|---|
| 5,563,634 A | * | 10/1996 | Fujii et al. | 347/54 |
| 5,668,579 A | * | 9/1997 | Fujii et al. | 347/54 |
| 5,691,752 A | * | 11/1997 | Moynihan et al. | 347/68 |
| 5,757,402 A | * | 5/1998 | Günther et al. | 347/68 X |
| 5,818,473 A | * | 10/1998 | Fujii et al. | 347/54 X |
| 5,975,668 A | * | 11/1999 | Fujii et al. | 347/54 X |
| 5,984,447 A | * | 11/1999 | Ohashi | 347/71 X |

FOREIGN PATENT DOCUMENTS

| | | |
|---|---|---|
| EP | 580 283 | 1/1994 |
| JP | 5-31898 | 2/1993 |
| JP | 6-71882 | 3/1994 |
| JP | 7-266558 | 10/1994 |

OTHER PUBLICATIONS

Fink, D.G. and Christiansen, D. "Integrated–Circuit Design." In: Electronics Engineers' Handbook—Third Edition (New York, McGraw Hill, 1989) pp. 8–45–8–106. TK7825.E34.*

* cited by examiner

*Primary Examiner*—Raquel Yvette Gordon
*Assistant Examiner*—Charlene Dickens

(57) ABSTRACT

In an ink jet head for performing charging and discharging between diaphragms and electrodes to transform the diaphragms to thereby eject ink drops from nozzle holes, a control circuit (60) of this ink jet head is constituted by an integrated circuit which is provided on a nozzle plate (300), a diaphragm substrate (200) or an electrode glass substrate (100) of an ink jet head chip (7).

15 Claims, 11 Drawing Sheets

Charge-time (1)

Discharge-time (1)

Charge-time (2)

Discharge-time (2)

INK JET HEAD WITH AN INTEGRATED CHARGING CONTROL CIRCUIT

FIELD OF THE INVENTION

The present invention relates to an ink jet head for ejecting ink drops and performing printing with the ink drops on paper or the like, and an ink jet recording apparatus with such an ink jet head mounted thereon.

BACKGROUND OF THE INVENTION

Recently, an ink jet recording apparatus has become required to have a very small actuator because it has become higher in printing speed and smaller in size due to its multi-nozzle structure. Therefore, there is an ink jet recording apparatus in which electrostatic power is used for an actuator (for example, JP-A-6-71882). In this ink jet recording apparatus, the actuator is constituted by parallel plate electrodes, so that the apparatus has a feature that the actuator can be miniaturized, and a multi-nozzle structure can be realized.

The summary of this ink jet head driven by an electrostatic actuator will be described on the basis of the sectional view of FIG. 12 and the plan view of FIG. 13. The ink jet head of FIGS. 12 and 13 has a stack structure in which an electrode glass substrate 100, a diaphragm substrate 200 and a nozzle plate 300 are alternately stacked one after another and bonded with each other. Ink 400 supplied to a reservoir 204 from an ink supply port 104 opened in the electrode glass substrate 100 is distributed equally to a plurality of cavities 203 through orifices 302. The lower surface of each cavity 203 is constituted by a transformable diaphragm 201 so as to face an individual electrode 101 through an insulating film 202 for preventing shortcircuit to thereby constitute an electrostatic actuator 50. A voltage is applied between the diaphragm 201 and the individual electrode 101 so that an electrostatic attractive force is generated to thereby transform the diaphragm 201 downward. Then, an ink drop 401 is ejected from a nozzle 301 by the pressure of a spring force of the diaphragm 201 generated when the applied voltage is removed.

However, in a direct driving system in which a voltage is applied to individual electrodes 101 directly, n wirings to individual electrode pads 102 and one wiring to a GND pad, that is, (n+1) wirings in total from a control circuit 2 are required when n electrostatic actuators ($C_1$ to $C_n$) 50 are provided, as shown in the circuit diagram of FIG. 14. Therefore, not only the space for a wiring connection portion increases, but also it is difficult to ensure the reliability. Particularly, the electrostatic capacity of the electrostatic actuators 50 is very small so that it may couple with the electrostatic capacity of each of the individual wirings from the control circuit 2. Accordingly, there has been a possibility of generation of scattering in the electrical characteristics of the electrostatic actuators 50.

In addition, JP-A-5-31898 discloses an ink jet head in which, in order to avoid complex wiring, on a substrate having a plurality of exoergic resistance elements arranged thereon, functional elements, integrated circuits and contacts for connecting the substrate to the outside are formed on the substrate. However, this ink jet head adopts a driving method called a bubble jet system, and its configuration is different from that of the above-mentioned ink jet head having the electrostatic actuators. Therefore, it was impossible to apply the head disclosed in the above Publication, as it is, to an ink jet head adopting electrostatic actuators.

DISCLOSURE OF THE INVENTION

It is an object of the present invention to provide an ink jet head adopting electrostatic actuators in which the total number of wirings is reduced so that not only the reduction of the space of a wiring connection portion can be intended, but also the reliability can be ensured.

It is another object of the present invention to provide an ink jet head in which printing accuracy is improved in addition to the above-mentioned object.

It is a further object of the present invention to provide an ink jet recording apparatus mounted with the above-mentioned ink jet head mounted thereon.

(A) According to the present invention, provided is an ink jet head which comprises an ink jet head chip having a plurality of nozzle holes, a plurality of independent ejection chambers communicating with the nozzle holes respectively, diaphragms constituting at least one-side walls of the ejection chambers, and individual electrodes disposed so as to be opposite to the diaphragms through air gaps respectively, and a control circuit for applying voltages between the diaphragms and the electrodes to perform charging/discharging so as to transform the diaphragms so that ink drops are ejected from the nozzle holes, respectively, wherein at least a part of the control circuit is constituted by an integrated circuit, and provided in the ink jet head chip.

In this invention, the control circuit is provided in the ink jet head chip. Therefore, not only it is possible to reduce the space of the wiring connection portion, but also it is possible to prevent the electrical characteristics of the electrostatic actuators from scattering. Accordingly, also from these points, it is possible to ensure the reliability.

(B) Further, in the above ink jet head according to the present invention, a part of or a whole of the control circuit is provided on a substrate (nozzle substrate) in the ink jet head chip, the plurality of nozzle holes being formed on the substrate.

The reason why control circuit is provided on the nozzle substrate according to the present invention is as follows.

① The nozzle substrate is preferable for manufacturing an integrated circuit, because the heating step is gentle although the substrate is subjected to the heating step.

② The nozzle substrate and the diaphragm substrate can be bonded with a bonding agent, and there is no fear that the control circuit is broken.

③ Since any substrate is sufficient for the nozzle substrate so long as a nozzle hole is opened therein, there is less limitation about the thickness in the nozzle substrate, and an Si substrate of a standard thickness (400 to 500 $\mu$m) may be used as the nozzle substrate.

In addition, when the control circuit is provided on the front surface (outside surface) of the nozzle substrate, there is an advantage that the availability of the substrate is high since a one-side mirror wafer can be used as the nozzle substrate.

In addition, when the control circuit is provided on the back surface (bonded surface) of the nozzle substrate, epoxy resin used for bonding the nozzle substrate with the diaphragm substrate may be used for a mold, so that no step is produced in the front surface of the nozzle substrate.

(C) Further, in the above ink jet head according to the present invention, a part of or a whole of the control circuit is provided on a substrate in the ink jet head chip, the diaphragms being formed on the substrate.

The reason why the control circuit is provided on the diaphragm substrate in the present invention is as follows.

① Since the diaphragm substrate is formed of an Si single-crystal wafer, the control circuit can be built in on one and the same substrate.

② All the steps other than the wet etching step, that is, the boron diffusion step, the thermal oxidation step, the patterning step of a thermally oxidized film, the electrode sputtering step, and so on, are common to each other between the cavity formation and the integrated circuit formation. Accordingly, it is possible to reduce the number of step.

Particularly, when the control circuit is provided on the back surface (on the electrode glass substrate side) of the diaphragm substrate, the mechanism becomes simple since a current can be applied to the individual electrode only by providing bumps or the like.

(D) Further, in the above ink jet head according to the present invention, a part of or a whole of the control circuit is provided on a substrate in the ink jet head chip, the individual electrodes being formed on the substrate.

When the control circuit is formed on the electrode substrate (glass substrate) according to the present invention, there are advantages as follows.

① When a part of the control circuit is constituted by a TFT, the individual electrode and the control circuit can be manufactured on one and the same substrate by manufacturing the TFT on a neutral borosilicate glass through a passivation film, so that the connection between the individual electrode and the control circuit becomes easy.

② The operation of the TFT can be confirmed by bringing a contact probe into contact with the individual electrode having a large area, so that inspection is easy.

(E) Further, in the above ink jet head according to the present invention, the control circuit has a resistor interposed in a charging path for each of electrostatic actuators constituted by the diaphragm and the individual electrode, and a resistor interposed in a discharging path for the electrostatic actuator, the value of the resistor interposed in the charging path being set to be larger than the value of the resistor interposed in the discharging path.

The time constant is increased by increasing the resistant value of the charging path, so that the electrostatic actuator can be driven gently. Accordingly, the electrostatic actuator can cope with the fluid resistance of an ink supply system. In addition, the time constant is reduced by reducing the resistant value of the charging path, so that the electrostatic actuator can be driven suddenly. A stable operation can be obtained by driving the electrostatic actuator in a manner as described above so that high resolution printing can be obtained.

(F) Further, in the above ink jet head according to the present invention, the control circuit switches the direction of charging for each electrostatic actuator constituted by the diaphragm and the individual electrode between the forward and backward directions alternately so as to make the ink jet head eject an ink drop twice for every dot. For example, the control circuit has switching elements connected in a bridge form to the each electrostatic actuator, and controls the open/close of the switching elements to thereby switch the direction of charging.

The quantity of ink to be ejected every time is reduced by ejecting an ink drop twice for every dot in such a manner, so that high resolution printing can be performed. In addition, since the direction of charging the electrostatic actuator is switched between the forward and backward directions alternately, residual charge after ejection is canceled, so that the relative displacement between the diaphragm and the electrode at the time of printing becomes stable. Also from this point, high resolution printing can be performed.

(G) In addition, an ink jet recording apparatus according to the present invention is provided with the above-mentioned ink jet head mounted thereon. Accordingly, an ink jet recording apparatus in which high quality printing can be performed is realized.

THE BEST MODE FOR CARRYING-OUT THE INVENTION

Embodiment 1

Figure 1:
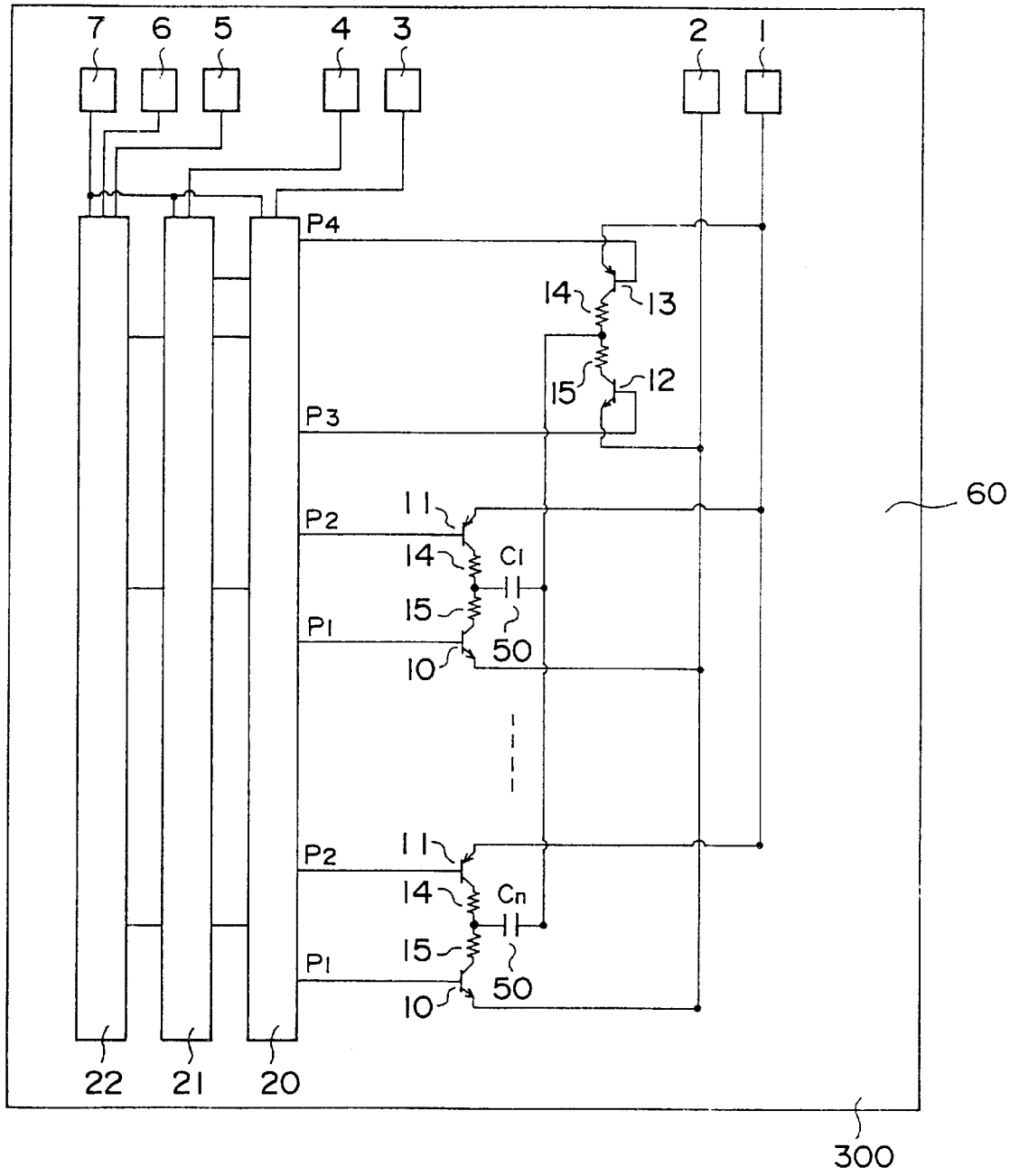
FIG. 1 is a circuit diagram of a control circuit of an ink jet head according to an embodiment 1 of the present invention.

In an ink jet head according to the embodiment 1, n electrostatic actuators ($C_1$ to $C_n$) 50 are provided as shown in the circuit diagram of FIG. 1. A $V_H$ terminal 1 is connected to the emitters of transistors 11 and 13, and a GND terminal 2 is connected to the emitters of transistors 10 and 12. The collectors of the transistors 10 and 11 are connected to each other through resistors 14 and 15, and one set of these transistors are provided for every individual electrode. Also collectors of the transistors 12 and 13 are connected to each other through resistors 14 and 15, and one set of these transistors are provided on a common electrode side. One electrode of each electrostatic actuator ($C_1$ to $C_n$) 50 is connected to a junction point between the resistors 14 and 15 on the transistors 10 and 11 sides, while the other electrode is connected to a junction point between the resistors 14 and 15 on the transistors 12 and 13 sides.

A control signal 3*a* for applying a forward/backward driving voltage to the actuators 50 is supplied to a strobe terminal 3 from the outside, and the control signal 3*a* is supplied to a driving control circuit 20. A latch signal 4*a* is supplied to a latch terminal 4, and the latch signal 4*a* is supplied to a latch circuit 21. Serial data are supplied to a data terminal 5, a clock is supplied to a clock terminal 6, and a logic power source is supplied to a logic power source terminal 7. Data and so on supplied to these terminals 5 to 7 are supplied to a shift register circuit 22. In addition, the logic power source from the logic power source terminal 7 is supplied also to the latch circuit 21 and the driving control circuit 20. A control circuit 60 having such a configuration is assembled in a nozzle plate 300 (see FIG. 7), as will be described later.

Figure 2:
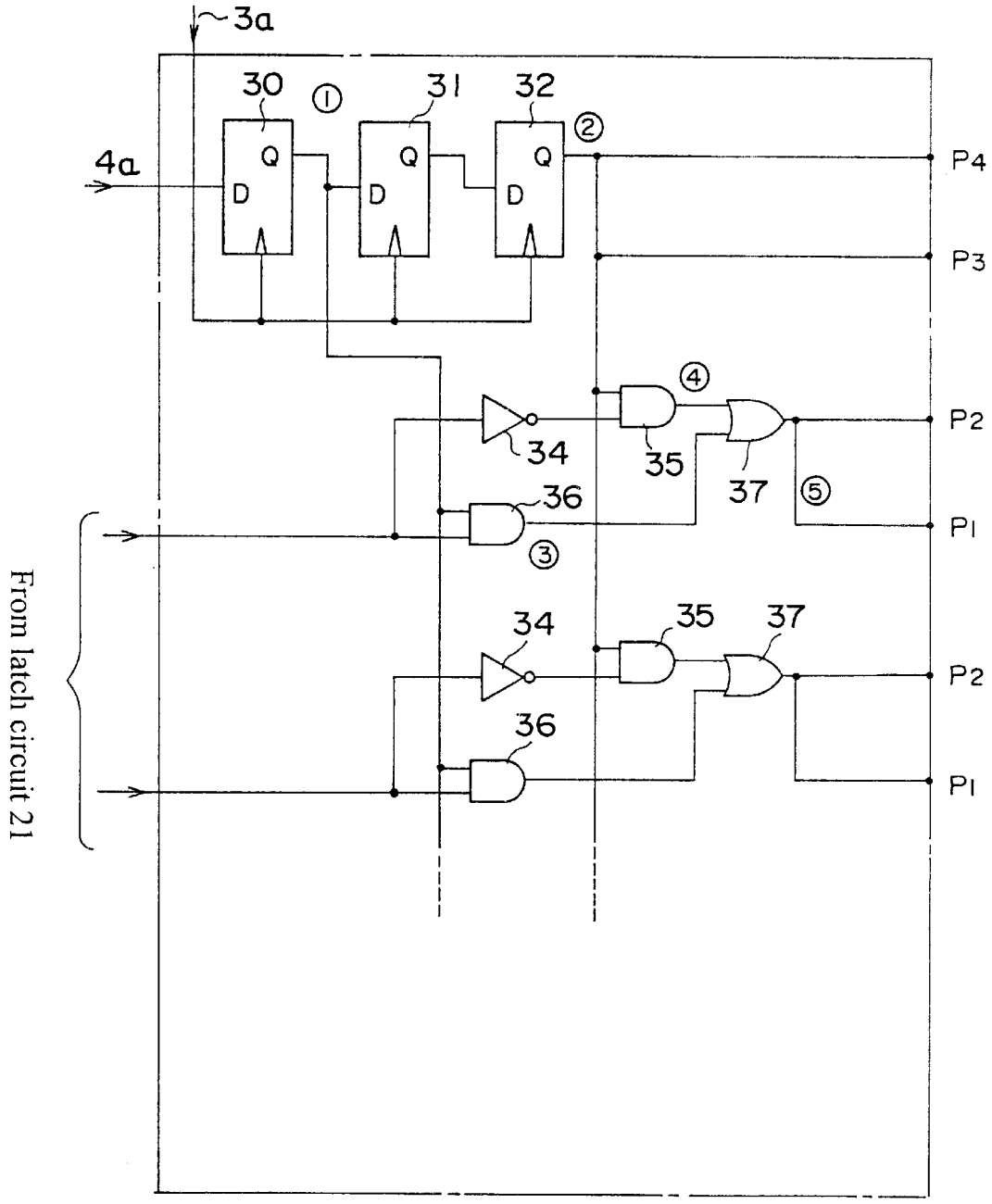
FIG. 2 is a circuit diagram of a driving control circuit in FIG. 1.

Next, the driving control circuit 20 in FIG. 1 will be described in detail. This driving control circuit 20 is constituted by D-type flip-flop circuits (hereinafter abbreviated to "DFF circuits") 30, 31 and 32, an inverter 34, AND circuits 35 and 36, and an OR circuit 37, as shown in FIG. 2. One set of the inverter 34, the AND circuits 35 and 36 and the OR circuit 37 are provided for every dot.

Figure 3:
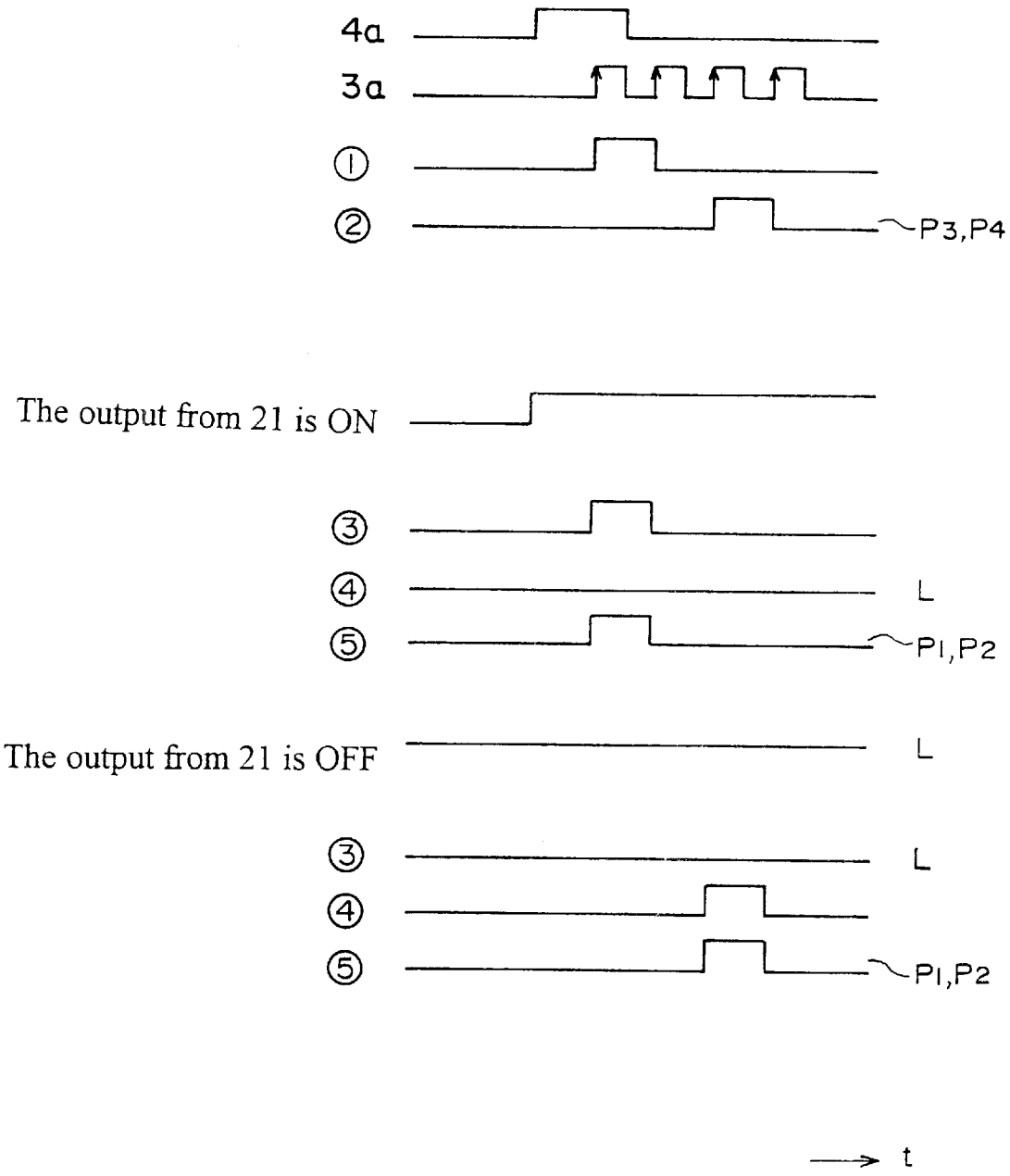
FIG. 3 is a timing chart showing the operation of the driving control circuit in FIG. 2.

In this driving control circuit 20, as shown in the timing chart of FIG. 3, the latch signal 4*a* (it takes an L level just before the second pulse of the control signal 3*a*) is inputted to a data terminal of the DFF 30. When the first pulse of the control signal 3*a* is inputted to the clock terminal at that timing, the output of the DFF 30 is changed to an H level from the L level. Next, when the second pulse of the control signal 3*a* is inputted to the clock terminals of the DFF 30 to 32, the output of the DFF 30 is changed to the L level from the H level, and the output of the DFF 31 is changed to the H level from the L level. Further, when the third pulse of the control signal 3*a* is inputted to the clock terminals of the DFF 30 to 32, the output of the DFF 31 is changed to the L level from the H level, and the output of the DFF 32 is changed to the H level from the L level. When the fourth pulse of the control signal 3*a* is inputted to the clock terminals of the DFF 30 to 32, the output of the DFF 32 is changed to the L level from the H level. Thus, latch signals 4*a* are outputted from the DFF 30 to 32 sequentially in synchronism with the leading edges of pulses of the control signal 3*a*.

The above-mentioned output of the DFF 32 is outputted as outputs P3 and P4. These outputs P3 and P4 are outputted in synchronism with the leading edges of the third pulse of the control signal 3*a* and independently of data from the latch circuit 21.

In addition, the output of the latch circuit 21 is supplied to the AND circuit 35 through the inverter 34 together with the output of the DFF 32, and the AND logic of the both signals is obtained in the AND circuit 35. The output of the DFF 30 is also supplied to the AND circuit 36 together with the data from the latch circuit 21, and the AND logic of the both signals is obtained in the AND circuit 36. The outputs of the AND circuits 35 and 36 are supplied to the OR circuit 37. The output of the OR circuit is outputted as P1 and P2.

For example, in the case where the data from the latch circuit 21 is in the H level (at the time of ejection), when the output (①) of the DFF circuit 30 is in the H level, also the output (③) of the AND circuit 36 turns to the H level, as shown in FIG. 3. The output (③) becomes an output(⑤) of the OR circuit 37, and is outputted as the outputs P1 and P2 (therefore, the outputs P1 and P2 are in synchronism with the output (①) of the DFF circuit 30). Then, when the output (①) of the DFF circuit 30 turns to the L level, also the output (③) of the AND circuit 36 turns to the L level. Then, since the data (H level) from the latch circuit 21 is inputted to the AND circuit 35 through the inverter 34, the output of the AND circuit 35 turns to the L level, and also the output of the OR circuit 37 turns to the L level. Accordingly, the outputs P1 and P2 turn to the L level. Therefore, the outputs P1 and P2 become pulses synchronized with the output (①) of the DFF circuit 30. That is, the outputs P1 and P2 become pulses which rise up in synchronism with the leading edge of the first pulse of the control signal 3*a*, and fall in synchronism with the leading edge of the second pulse.

In addition, in the case where the data from the latch circuit 21 is in the L level (at the time of not-ejection), when the output (②) of the DFF circuit 32 is in the H level, also the output (④) of the AND circuit 35 is in the H level, as shown in FIG. 3. The output (④) becomes an output (⑤) of the OR circuit 37, and is outputted as the outputs P1 and P2. Therefore, the outputs P1 and P2 become pulses synchronized with the output (②) (: output P3) of the DFF circuit 32. That is, the outputs P1 and P2 become pulses which rise up in synchronism with the leading edge of the third pulse of the control signal 3*a*, and fall in synchronism with the leading edge of the fourth pulse.

Next, the operation of the ink jet head in FIG. 1 as a whole will be described with reference to the timing chart of FIG. 4 and the explanatory diagram of FIG. 5.

Figure 4:
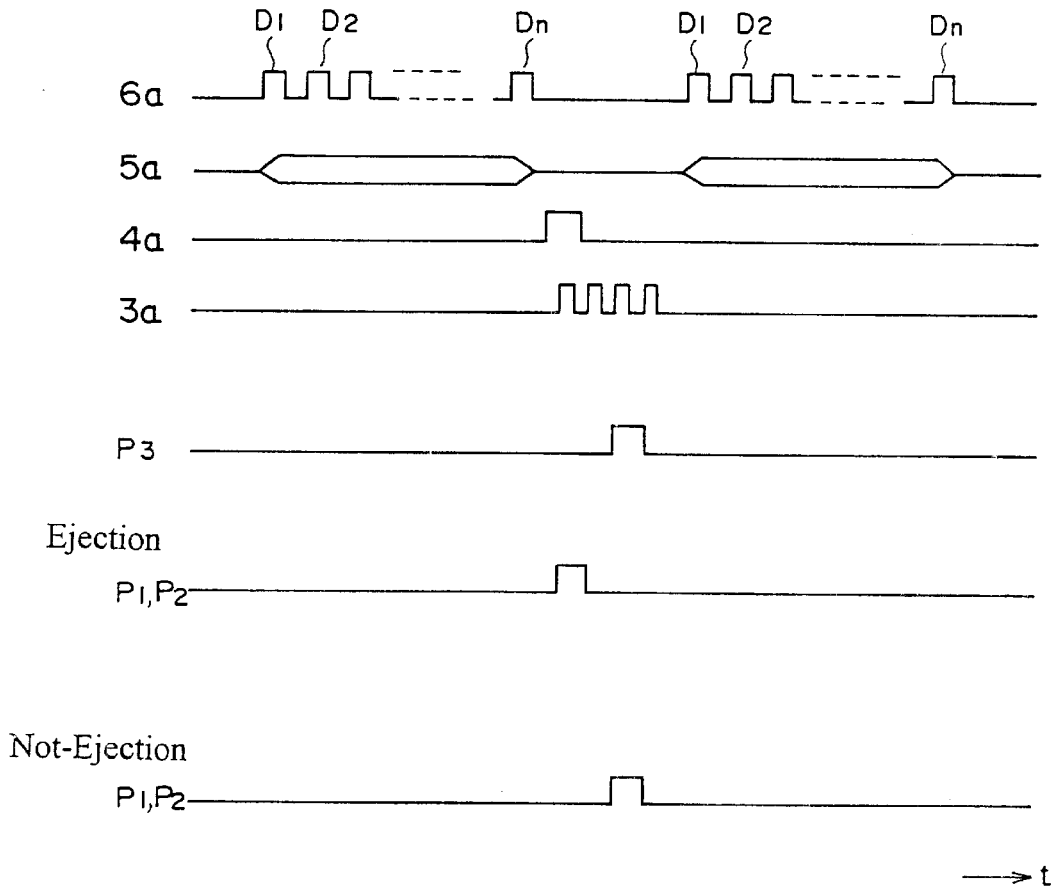
FIG. 4 is a timing chart showing the operation of the ink jet head in FIG. 1.
Figure 5A:
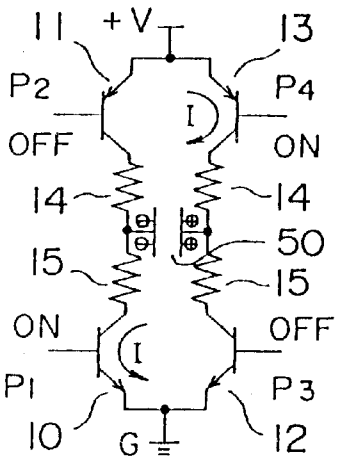
FIGS. 5A–5D are explanatory diagrams of the operation at the time when the ink jet head in FIG. 1 ejects an ink drop.
Figure 5B:
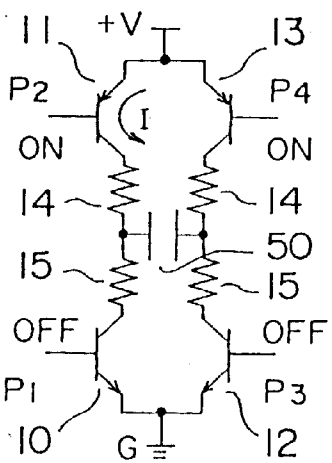
Figure 5C:
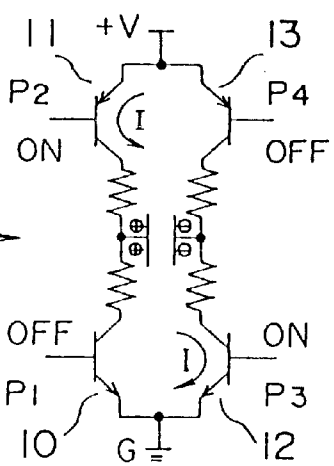
Figure 5D:
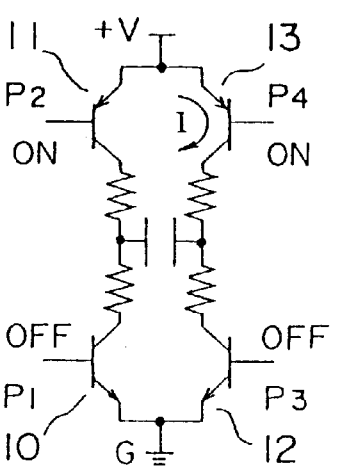
Figure 6A:
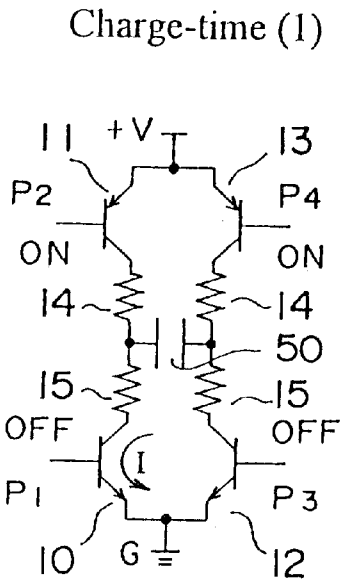
FIGS. 6A–6D are explanatory diagrams of the operation at the time when the ink jet head in FIG. 1 does not eject any ink drop.
Figure 6B:
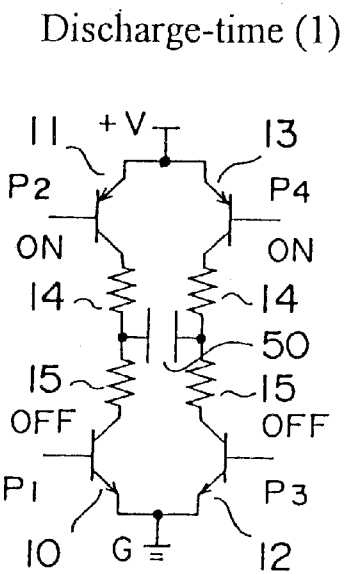
Figure 6C:
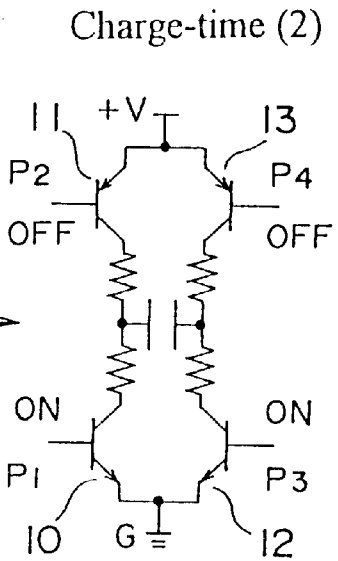
Figure 6D:
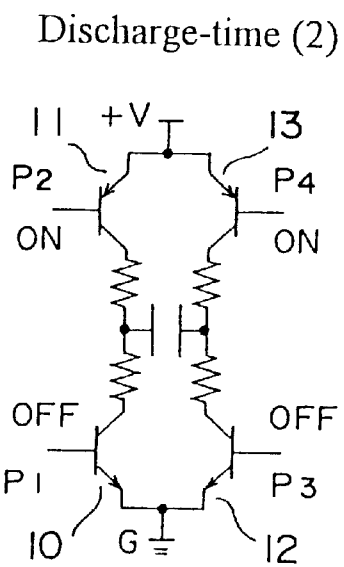

As shown in FIG. 4, the clock 6*a* and the serial data 5*a* synchronized with the clock 6*a* are inputted to the shift register circuit 22 from the clock terminal 6 and the data terminal 5. When the latch signal 4*a* is inputted to the latch circuit 21 through the latch terminal 4 in the state where all n data ($D_1$ to $D_n$) have been set, the n data ($D_1$ to $D_n$) are held by the latch circuit 21. In the state where the data are held, the control signal 3*a* constituted by 4 pulses as shown in FIG. 4 is supplied to the strobe terminal 3, and then the signal is supplied to the driving control signal 20.

(Operation at the Time of Ejection)

First, the operation at the time of ejection will be described.

In the driving control circuit 20, for the electrostatic actuators 50 intended to eject, first, the outputs P1 and P2 are brought into the H level at the leading edge of the first pulse of the control signal 3*a*, as mentioned above. As a result, the transistor 10 is turned ON, and the transistor 11 is turned OFF. At this time, the transistor 12 is in the OFF state and the transistor 13 is in the ON state, because the outputs P3 and P4 are in the L level. Therefore, a charging circuit constituted by the transistor 13, the resistor 14, the electrostatic actuator 50, the resistor 15 and the transistor 10 is formed as shown in Charge-Time (1) of FIG. 5 so as to charge the electrostatic actuator 50.

Then, at the leading edge of the second pulse of the control signal 3*a*, the driving control circuit 20 brings the outputs P1 and P2 into the L level. Therefore, the transistor 10 is turned OFF, and the transistor 11 is turned ON, as shown in Discharge-Time (1) of FIG. 5. At this time, the transistors 12 and 13 are kept in their previous states (OFF and ON) since the outputs P3 and P4 are not changed. Therefore, the charge of the electrostatic actuator 50 is discharged only through the resistor 14. Here, the resistant value of the resistor 15 takes a high value since the time constant is made large, so that the electrostatic actuator 50 is driven gently so as to cope with the fluid resistance of the ink supply system. On the other hand, the time constant of the resistor 14 is made small in order to obtain a speed at the time of ink ejection, taking it into consideration that the electrostatic actuator 50 can be driven suddenly.

Next, at the leading edge of the third pulse of the control signal 3*a*, the driving control circuit 20 brings the outputs P3 and P4 into the H level. At this time, the outputs P1 and P2 are left in the L level. Consequently, the transistor 12 is turned into the ON state and the transistor 13 is turned into the OFF state while the transistor 10 is left in the OFF state and the transistor 11 is left in the ON state, as shown in Charge-Time (2) of FIG. 5. Therefore, a charging circuit constituted by the transistor 11, the resistor 14, the electrostatic actuator 50, the resistor 15 and the transistor 12 is formed so as to charge the electrostatic actuator 50 in the direction reverse to that in Charge-Time (1) of FIG. 5.

Next, at the leading edge of the fourth pulse of the control signal 3*a*, the driving control circuit 20 brings the outputs P3 and P4 into the L level.

Therefore, the transistor 12 is turned OFF, and the transistor 13 is turned ON, as shown in Discharge-Time (2) of FIG. 5. At this time, the transistors 10 and 11 are kept in their previous states (ON and OFF) since the outputs P1 and P2 are not changed. Therefore, the charge of the electrostatic actuator 50 is discharged only through the resistor 14 in the direction reverse to that in Discharge-Time (1) of FIG. 5.

As described above, charging and discharging of the electrostatic actuator 50 are repeated twice correspondingly to 4 pulses of the control signal 3*a*, so that an ink drop is ejected twice for every dot from a corresponding nozzle hole.

(At the Time of Not-Ejection)

Next, the operation at the time of not-ejection will be described.

The driving control circuit 20 makes the outputs P1 and P2 corresponding to the electrostatic actuators 50 which will not perform ejection synchronized with the outputs P3 and P4, as mentioned above. Therefore, at the leading edge of the first pulse of the control signal 3*a*, the transistors 11 and 13 turn into the ON state, while the transistors 10 and 12 turn into the OFF state, as shown in Charge-Time (1) of FIG. 6. At the leading edge of the second pulse of the control signal 3*a*, the transistors 11 and 13 turn into the ON state, while the transistors 10 and 12 turn into the OFF state, as shown in Discharge-Time (1) of FIG. 6. At the leading edge of the third pulse of the control signal 3*a*, the transistors 10 and 12 turn into the ON state, while the transistors 11 and 13 turn into the OFF state, as shown in Charge-Time (2) of FIG. 6. At the leading edge of the fourth pulse of the control signal 3*a*, the transistors 11 and 13 turn into the ON state, while the transistors 10 and 12 turn into the OFF state, as shown in Discharge-Time (2) of FIG. 6. Since the transistors 10 to 13 operates in such a manner, neither a charging circuit nor a discharging circuit is formed for the electrostatic actuator 50. Accordingly, the electrostatic actuator 50 is not driven, so that no ink drop is ejected from the nozzle hole corresponding to the electrostatic actuator 50.

Figure 7:
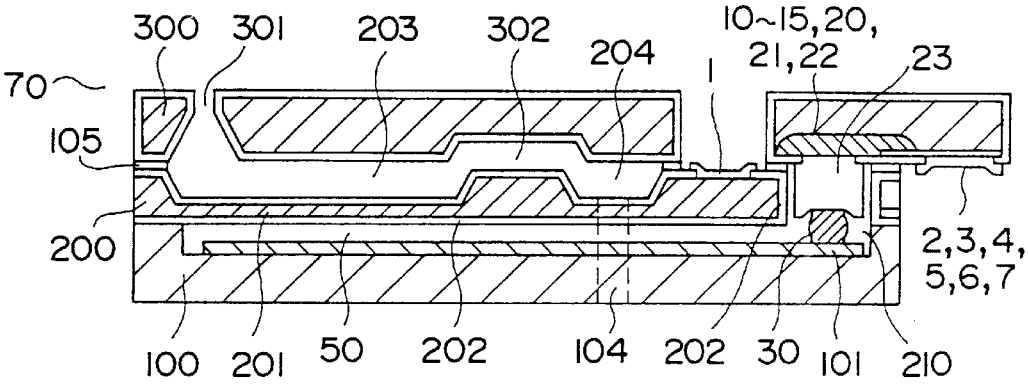
FIG. 7 is a sectional view of the ink jet head in the embodiment shown in FIG. 1.

The ink jet head in this embodiment 1 is configured as shown in the sectional view of FIG. 7. A main part of the ink jet head in this embodiment 1 is constituted by an ink jet head chip 70 having such a structure that an electrode glass substrate 100 of borosilicated glass, a diaphragm substrate 200 of a single-crystal silicon substrate, and a nozzle plate 300 of a single-crystal silicon substrate, glass or plastics are stacked one on another. The transistors 10 to 13, the resistors 14 and 15, the driving control circuit 20, the latch circuit 21, the shift register circuit 22 and the bump 23 are assembled into the nozzle plate 300 through an ordinary semiconductor process after a nozzle 301 and an orifice 302 are formed by an organic alkali etching liquid such as tetramethylammonium hydroxide water-solution, or the like, containing no alkali metal. Wirings are led from these circuits to the GND terminal 2, the strobe terminal 3, the latch terminal 4, the data terminal 5, the clock terminal 6 and the logic power source terminal 7. The electrode glass substrate 100 and the diaphragm substrate 200 are bonded with each other by anode bonding. An insulating layer based on an insulating film 202 provided with a through hole 210 opened by etching the diaphragm substrate 200 is formed on the upper surface of an individual electrode 101. After a solder ball 30 is disposed at the through hole 210, the nozzle plate 300 is heated and contact-bonded with the diaphragm substrate 200 through a bonding layer 105. At the same time, the solder ball 30 is melted to thereby connect the individual electrode 101 to the bump 23. In addition the $V_H$ terminal 1 is provided on the diaphragm substrate 200 of a low-resistant Si substrate.

In this embodiment 1, as is apparent from the above description, a control circuit for driving the electrostatic actuators 50 is disposed on a substrate of an ink jet head chip. Accordingly, the number of wirings is only seven (terminals 1 to 7) as shown in FIG. 1, even if the number of the electrostatic actuators 50 is increased extremely. Therefore, the reliability of connection portions is improved, and wiring connection portions can be collected in a small size.

In addition, there is no scattering in capacity of wiring portions connected to the electrostatic actuators ($C_1$ to $C_n$) 50, or the scattering is small even if it exists. Accordingly, no scattering is generated in operation among the electrostatic actuators ($C_1$ to $C_n$) 50.

In addition, the direction of an electric field for driving the electrostatic actuators 50 is switched alternately, so that no charge is generated in an insulating film separating electrodes from each other. Accordingly, diaphragms constituting the electrostatic actuators ($C_1$ to $C_n$) 50 are recovered entirely, and the relative displacements between the diaphragms and the individual electrodes are not changed. Therefore, the quantity of ejected ink becomes stable so that high resolution printing can be performed.

Further, since an ink drop is ejected twice for every dot, the quantity of ejected ink every time can be reduced, so that high resolution printing can be performed. In addition, since the direction of charging (the direction of voltage application) for the electrostatic actuators ($C_1$ to $C_n$) 50 is switched between the forward and backward directions alternately, residual charge after ejection can be canceled. Accordingly, the relative displacements between the diaphragms and the electrodes at the time of printing are made stable. Also from this point, high resolution printing can be performed.

Embodiment 2

Figure 8:
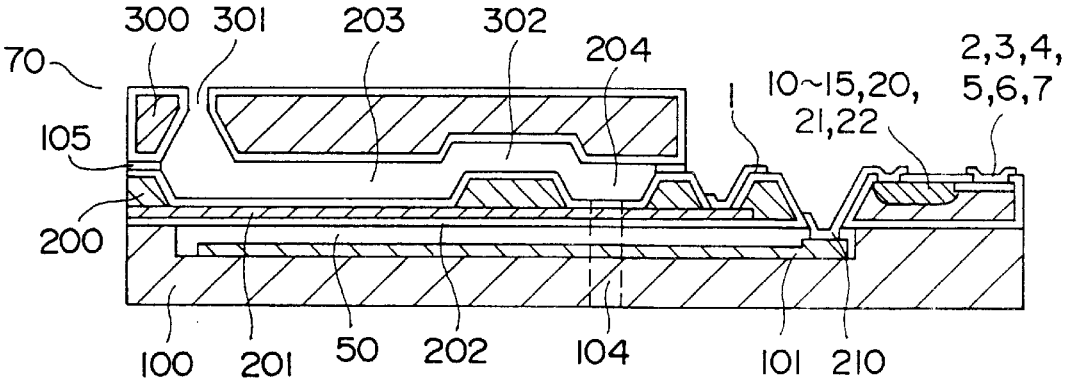
FIG. 8 is a sectional view of an ink jet head according to an embodiment 2 of the present invention.

An ink jet head according to this embodiment 2 is configured as shown in the sectional view of FIG. 8. In this embodiment, transistors 10 to 13, resistors 14 and 15, a driving control circuit 20, a latch circuit 21 and a shift register 22 are assembled in a diaphragm substrate 200. Although an Si substrate having a high resistant value is used, the electric resistance is reduced by diffusing boron in a diaphragm 201 in order to reduce the wiring resistance of the diaphragm 201. The transistors 10 to 13 are connected to an individual electrode 101 through a through hole 210 opened in the diaphragm substrate 200. In addition, the diaphragm substrate 200 is dug down so that $V_H$ terminal 1 is electrically connected to the diaphragm 201 directly.

Embodiment 3

Figure 9:
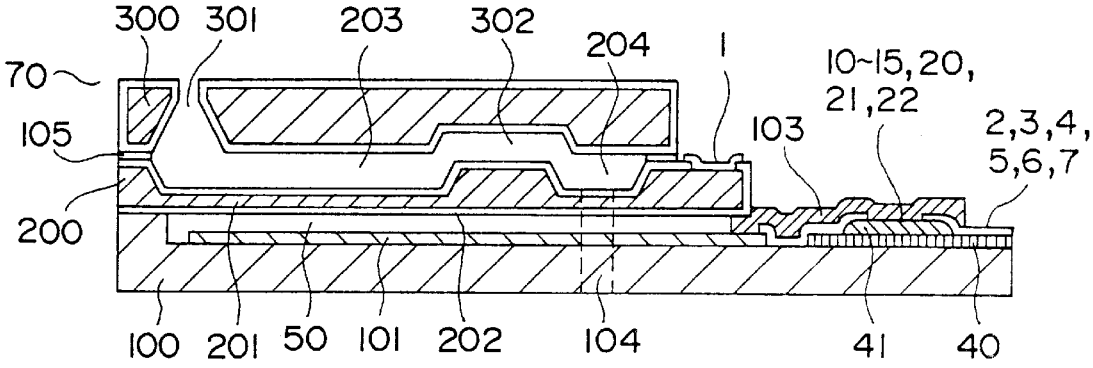
FIG. 9 is a sectional view of an ink jet head according to an embodiment 3 of the present invention.

An ink jet head according to this embodiment 3 is configured as shown in FIG. 9. In this embodiment, transistors 10 to 13, resistors 14 and 15, a driving control circuit 20, a latch circuit 21 and a shift register 22 are assembled in an electrode substrate 100. The electrode glass substrate 100 is bonded with a diaphragm substrate 200 of single-crystal silicon directly, and borosilicated glass is used for the electrode glass substrate 100. Therefore, for a circuit portion in which the driving control circuit 20, the latch circuit 21 and the shift register 22 are integrated, $SiO_2$ is sputtered to form a passivation film 40, for the purpose of preventing migration of alkali metal from the electrode glass substrate 100. On the passivation film 40, there is provided a poly-crystal Si film 41 recrystallized by laser annealing after deposition based on reduced-pressure CVD. The transistors 11 to 13, the driving control circuit 20, the latch circuit 21 and the shift register 22 are assembled in the poly-crystal Si film 41 through a TFT process. After the electrode glass substrate 100 and the diaphragm substrate 200 are bonded with each other, a circuit portion is protected by epoxy resin acting also as a seal 103 for the actuators 50.

Although the above-mentioned embodiments 1 to 3 show examples in which respective circuits are integrated on one and the same substrate, the circuits may be mounted on a plurality of substrates.

Embodiment 4

Figure 10:
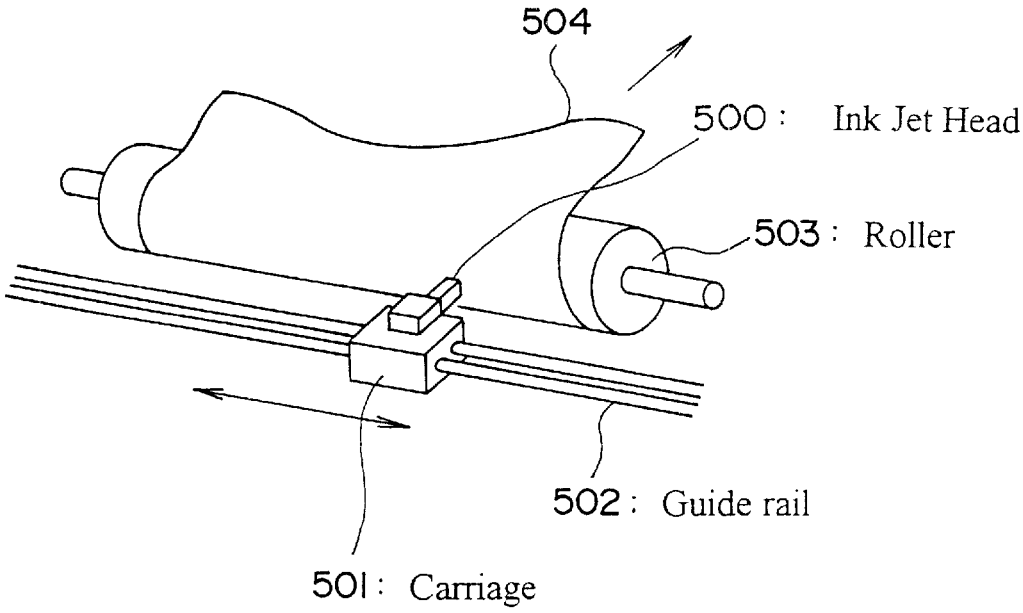
FIG. 10 is an explanatory view showing a mechanism around the ink jet head in FIG. 7, 8 or 9.
Figure 11:
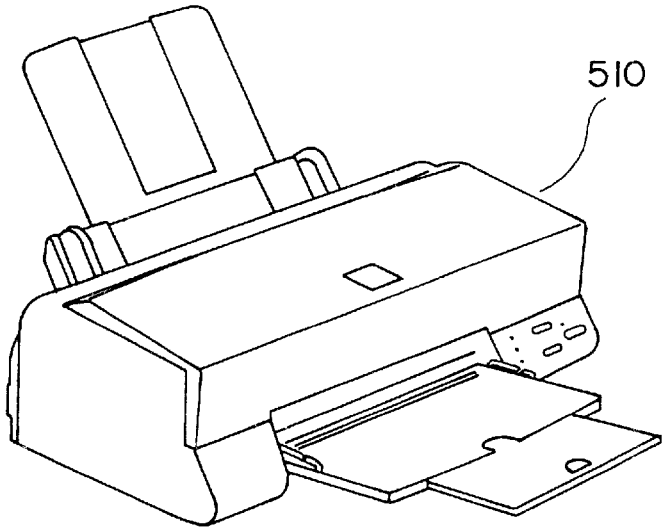
FIG. 11 is an outline view of an ink jet recording apparatus including the mechanism in FIG. 10.
Figure 12:
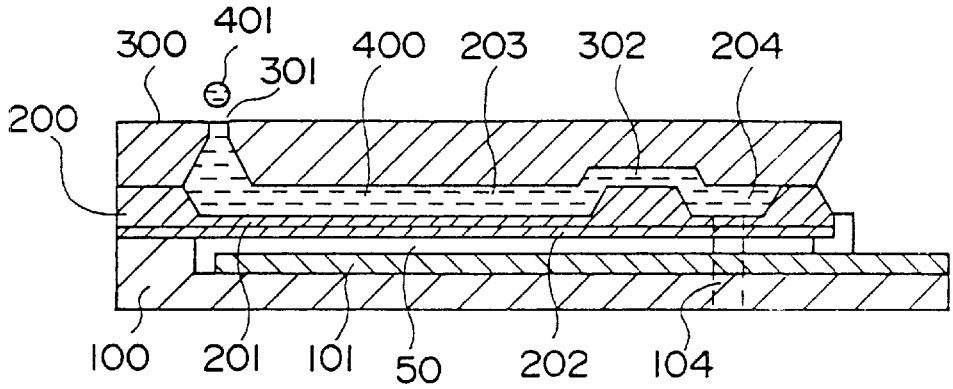
FIG. 12 PRIOR ART
FIG. 12 is a sectional view of a conventional ink jet head driven by electrostatic actuators.
Figure 13:
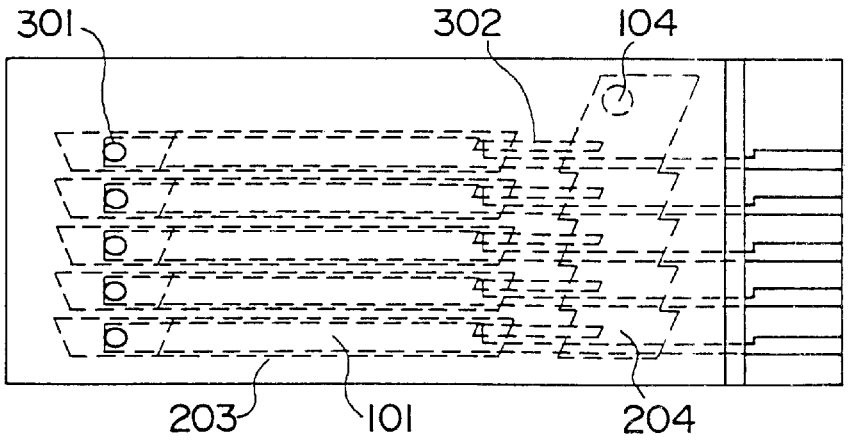
FIG. 13 PRIOR ART
FIG. 13 is a plan view of the ink jet head in FIG. 12.
Figure 14:
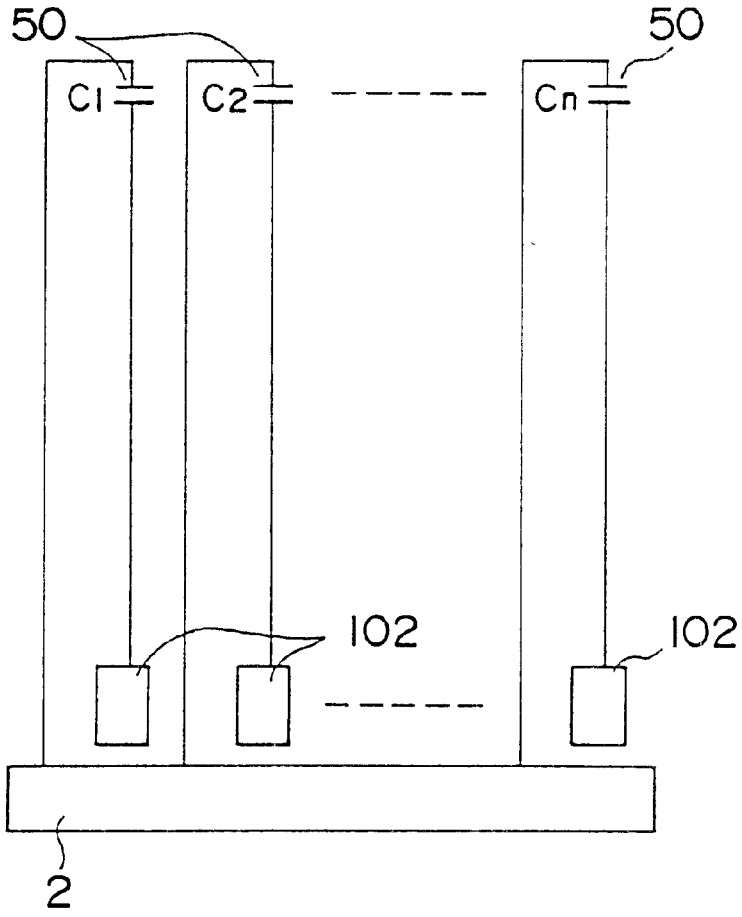
FIG. 14 PRIOR ART
FIG. 14 is a circuit diagram of the ink jet head in FIG. 12.

An ink jet head 500 in FIG. 7 to FIG. 9 is attached to a carriage 501 as shown in FIG. 10. This carriage 501 is attached to guide rails 502 movably, and the position of the carriage 501 is controlled in the width direction of paper 504 fed out by a roller 503. This mechanism in FIG. 10 is mounted on an ink jet recording apparatus 510 shown in FIG. 11.

What is claimed is:

1. An ink jet head comprising:

an ink jet head chip having:

(a) a nozzle hole formed in a nozzle substrate;

(b) an ejection chamber communicating with said nozzle hole; and (c) an electrostatic actuator including:

(i) a diaphragm constituting at least one side wall of said ejection chamber;

(ii) an individual electrode disposed so as to be opposite to said diaphragm and separated by an air gap; and (iii) a control circuit provided in said ink jet head chip to apply voltages between said diaphragm and said individual electrode to perform charging/discharging so as to transform said diaphragm so that ink drops are ejected from said nozzle hole;

wherein at least a part of said control circuit is constituted by an integrated circuit integrally constructed into said nozzle substrate.

2. An ink jet head according to claim 1, wherein said control circuit includes a first resistance interposed in a charging path for said electrostatic actuator constituted by said diaphragm and said individual electrode, and a second resistance interposed in a discharging path for said electrostatic actuator, wherein the first resistance is greater than the second resistance.

3. An ink jet head according to claim 2, wherein said first resistance comprises a first resistor and the second resistance comprises a second resistor.

4. An ink jet head according to claim 1, wherein said control circuit switches a direction of charging for said electrostatic actuator between first and second directions alternately so as to make said ink jet head eject an ink drop twice for every dot.

5. An ink jet head according to claim 4, wherein said control circuit includes switching elements connected in a bridge arrangement to said electrostatic actuator, and wherein said control circuit controls an open position and close position of said switching elements to thereby switch the direction of charging.

6. An ink jet head comprising:

an ink jet head chip having:

(a) a nozzle hole;

(b) an independent ejection chamber communicating with said nozzle hole; and (c) an electrostatic actuator including:

(i) a diaphragm constituting a diaphragm substrate and at least one side wall of said ejection chamber;

(ii) an individual electrode disposed so as to be opposite to said diaphragm and separated by an air gap; and (iii) a control circuit provided in said ink jet head chip to apply voltages between said diaphragm and said individual electrode to perform charging/discharging so as to transform said diaphragm so that ink drops are ejected from said nozzle hole;

wherein at least a part of said control circuit is constituted by an integrated circuit integrally constructed into said diaphragm substrate.

7. An ink jet head according to claim 6, wherein said control circuit includes a first resistance interposed in a charging path for said electrostatic actuator constituted by said diaphragm and said individual electrode, and a second resistance interposed in a discharging path for said electrostatic actuator, wherein the first resistance is greater than the second resistance.

8. An ink jet head according to claim 6, wherein said control circuit switches a direction of charging for said electrostatic actuator between first and second directions alternately so as to make said ink jet head eject an ink drop twice for every dot.

9. An ink jet head comprising:

an ink jet head chip having:

(a) a nozzle hole;

(b) an independent ejection chamber communicating with said nozzle hole; and (c) an electrostatic actuator including:

(i) a diaphragm constituting at least one side wall of said ejection chamber;

(ii) an individual electrode formed on an electrode substrate disposed so as to be opposite to said diaphragm and separated by an air gap; and (iii) a control circuit provided in said ink jet head chip to apply voltages between said diaphragm and said individual electrode to perform charging/discharging so as to transform said diaphragm so that ink drops are ejected from said nozzle hole;

wherein at least a part of said control circuit is constitute by an integrated circuit integrally constructed into said electrode substrate.

10. An ink jet head according to claim 9, wherein said control circuit includes a first resistance interposed in a charging path for said electrostatic actuator constituted by said diaphragm and said individual electrode, and a second resistance interposed in a discharging path for said electrostatic actuator, wherein the first resistance is greater than the second resistance.

11. An ink jet head according to claim 9, wherein said control circuit switches a direction of charging for said electrostatic actuator between first and second directions alternately so as to make said ink jet head eject an ink drop twice for every dot.

12. A method of operating an ink jet head having an electrostatic actuator comprising the steps of:

a) charging the actuator in a first direction to eject ink therefrom a first time; and b) after step a), charging the actuator in a second direction to eject ink therefrom a second time, the first direction being different than the second direction.

13. An ink jet recording apparatus comprising:

an ink jet head including:

an ink jet head chip having:

(a) a nozzle hole formed in a nozzle substrate;

(b) an independent ejection chamber communicating with said nozzle hole; and (c) a n electrostatic actuators including:

(i) a diaphragm constituting at least one side wall of said ejection chamber;

(ii) an individual electrode disposed so as to be opposite to said diaphragm and separated by an air gap; and (iii) a control circuit provided in said ink jet head chip to apply voltages between said diaphragm and said individual electrode to perform charging/discharging so as to transform said diaphragm so that ink drops are ejected from a respective one of said plurality of nozzle holes; wherein at least a part of said control circuit is constituted by an integrated circuit, integrally constructed into said nozzle substrate.

14. An ink jet recording apparatus comprising:

an ink jet head including:

an ink jet head chip having:

(a) a nozzle hole;

(b) an independent ejection chamber communicating with said nozzle hole; and (c) an electrostatic actuator including:

(i) a diaphragm constituting a diaphragm substrate and at least one side wall of said ejection chamber;

(ii) an individual electrode disposed so as to be opposite to said diaphragm and separated by an air gap; and (iii) a control circuit provided in said ink jet head chip to apply voltages between said diaphragm and said individual electrode to perform charging/discharging so as to transform said diaphragm so that ink drops are ejected from said nozzle hole;

wherein at least a part of said control circuit is constituted by an integrated circuit, integrally constructed into said diaphragm substrate.

15. An ink jet recording apparatus comprising:

an ink jet head including:

an ink jet head chip having:

(a) a nozzle hole;

(b) an independent ejection chamber communicating with said nozzle hole; and (c) an electrostatic actuator including:

(i) a diaphragm constituting at least one side wall of said ejection chamber;

(ii) an individual electrode formed on an electrode substrate disposed so as to be opposite to said diaphragm and separated by an air gap; and (iii) a control circuit provided in said ink jet head chip to apply voltages between said diaphragm and said individual electrode to perform charging/discharging so as to transform said diaphragm so that ink drops are ejected from said nozzle hole;

wherein at least a part of said control circuit is constitute by an integrated circuit integrally constructed into said electrode substrate.

* * * * *